US009932821B2

(12) United States Patent
Lange et al.

(10) Patent No.: US 9,932,821 B2
(45) Date of Patent: Apr. 3, 2018

(54) BEND ANGLE SENSING ASSEMBLY AND METHOD OF USE

(71) Applicant: Halliburton Energy Services, Inc., Houston, TX (US)

(72) Inventors: Gustav Edward Lange, Millet (CA); Kirkhope John Kennedy, Leduc (CA)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 342 days.

(21) Appl. No.: 14/779,286

(22) PCT Filed: Oct. 22, 2014

(86) PCT No.: PCT/US2014/061779
§ 371 (c)(1),
(2) Date: Sep. 22, 2015

(87) PCT Pub. No.: WO2016/064386
PCT Pub. Date: Apr. 28, 2016

(65) Prior Publication Data

US 2016/0326863 A1 Nov. 10, 2016

(51) Int. Cl.
*E21B 47/02* (2006.01)
*E21B 7/06* (2006.01)
(Continued)

(52) U.S. Cl.
CPC ..... *E21B 47/024* (2013.01); *E21B 4/02* (2013.01); *E21B 7/06* (2013.01); *E21B 7/067* (2013.01);
(Continued)

(58) Field of Classification Search
CPC ..... E21B 47/02; E21B 47/024; E21B 47/06; E21B 7/06; E21B 7/067; E21B 7/068; E21B 4/02; E21B 21/10
See application file for complete search history.

(56) References Cited

U.S. PATENT DOCUMENTS 3,464,120 A * 9/1969 Alder ..... E21B 7/04 175/45
4,596,294 A 6/1986 Russell
(Continued)

OTHER PUBLICATIONS

Cavo; "Motor Operations Manual-Fourth Edition (4.3)", 2005, Cavo Drilling Motors, Ltd. Co.
(Continued)

*Primary Examiner* — Jennifer H Gay
(74) *Attorney, Agent, or Firm* — Polsinelli PC

(57) ABSTRACT

A bend angle sensing assembly for determining a downhole bend angle of a downhole adjustable bent housing. The bend angle sensing assembly includes a flow diverter having a plurality of diverter apertures for receiving drilling fluid, the flow diverter orientable to a plurality of diverter configurations in dependence on the bend angle of the associated downhole adjustable bent housing. Each of the plurality of diverter configurations have one or more of the plurality of diverter apertures opening or closing to form a corresponding flow path configuration, each flow path configuration having a different flow area whereby the pressure of the drilling fluid changes for each flow path configuration. Additionally, a pressure sensor is communicatively coupled to the drilling fluid.

20 Claims, 15 Drawing Sheets

(51) Int. Cl.

| | |
|---|---|
| ***E21B 4/02*** | (2006.01) |
| ***E21B 21/10*** | (2006.01) |
| ***E21B 47/024*** | (2006.01) |
| ***E21B 47/06*** | (2012.01) |

(52) U.S. Cl.
CPC ..... *E21B 21/10* (2013.01); *E21B 47/02* (2013.01); *E21B 47/06* (2013.01)

(56) References Cited

U.S. PATENT DOCUMENTS

| | | | | |
|---|---|---|---|---|
| 4,597,454 | A | 7/1986 | Schoeffler | |
| 4,655,299 | A | 4/1987 | Schoeffler | |
| 4,745,982 | A | 5/1988 | Wenzel | |
| 5,117,927 | A | 6/1992 | Askew | |
| 5,215,151 | A | 6/1993 | Smith et al. | |
| 5,311,952 | A | 5/1994 | Eddison et al. | |
| 5,392,867 | A * | 2/1995 | du Chaffaut | E21B 7/06 175/38 |
| 5,669,457 | A | 9/1997 | Sebastian et al. | |
| 5,803,185 | A * | 9/1998 | Barr | E21B 7/06 175/45 |
| 6,047,784 | A | 4/2000 | Dorel | |
| 6,401,812 | B2 | 6/2002 | Leising | |
| 6,554,083 | B1 | 4/2003 | Kerstetter | |
| 7,311,153 | B2 | 12/2007 | McKee et al. | |
| 7,360,609 | B1 | 4/2008 | Falgout | |
| 7,481,282 | B2 | 1/2009 | Horst et al. | |
| 7,810,584 | B2 | 10/2010 | Haci et al. | |
| 7,823,660 | B2 | 11/2010 | Giroux et al. | |
| 7,882,904 | B2 | 2/2011 | von Gynz-Rekowski et al. | |
| 8,066,079 | B2 * | 11/2011 | de Boer | E21B 21/10 166/321 |
| 8,127,868 | B2 | 3/2012 | Giroux et al. | |
| 8,302,705 | B2 | 11/2012 | Downton | |
| 8,360,109 | B2 | 1/2013 | Johnson | |
| 8,360,172 | B2 | 1/2013 | Santelmann | |
| 8,434,567 | B2 | 5/2013 | Menezes et al. | |
| 8,708,064 | B2 * | 4/2014 | Downton | E21B 7/062 175/45 |
| 9,637,976 | B2 * | 5/2017 | Lorenson et al. | E21B 4/02 |
| 9,765,584 | B2 * | 9/2017 | Lorenson | E21B 4/02 |
| 2006/0283632 | A1 | 12/2006 | Hall et al. | |
| 2009/0211814 | A1 * | 8/2009 | de Boer | E21B 21/10 175/57 |
| 2011/0061938 | A1 | 3/2011 | Miszewski | |
| 2012/0013339 | A1 | 1/2012 | Kuckes | |
| 2012/0145462 | A1 | 6/2012 | Leising et al. | |
| 2012/0160565 | A1 * | 6/2012 | Downton | E21B 7/062 175/61 |
| 2012/0255780 | A1 | 10/2012 | Schmidt | |
| 2014/0246240 | A1 * | 9/2014 | Lorenson | E21B 4/02 175/57 |
| 2016/0281449 | A1 * | 9/2016 | Lorenson | E21B 4/02 |
| 2016/0326863 | A1 * | 11/2016 | Lange | E21B 47/02 |
| 2017/0159362 | A1 * | 6/2017 | Janes | E21B 7/068 |

OTHER PUBLICATIONS

OnePetro; "First Real Time Measurements of Downhole Vibrations, Forces and Pressures Used to Monitor Directional Drilling Operations". Copyright 1989, SPE/IADC Drilling Conference; http://www.onepetro.org/mslib/servlet/onepetropreview?id=00018651, retrieved on Jan. 8, 2014.

Schlumberger; Power Pak "Steerable Motor Handbook", Schlumberger, 2004.

International Search Report and the Written Opinion of the International Searching Authority dated Jul. 16, 2015 in the International Application No. PCT/US2014/061779.

* cited by examiner

BEND ANGLE SENSING ASSEMBLY AND METHOD OF USE

CROSS-REFERENCE TO RELATED APPLICATIONS

This application is a national stage entry of PCT/US2014/061779 filed Oct. 22, 2014, said application is expressly incorporated herein in its entirety.

FIELD

The present disclosure relates generally to directional drilling in oil and gas exploration and production operations. In particular, the present disclosure relates to a bend angle sensing assembly for determining a downhole bend angle of a downhole adjustable bent housing.

BACKGROUND

Wellbores are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Directional drilling typically requires controlling and varying the direction of the drill string and drilling device during drilling. Oftentimes the goal of directional drilling is to reach a position within a target subterranean destination or formation. Various options are available for providing steering capabilities to a drilling device for controlling and varying the direction of the wellbore. In directional drilling applications, for example, one option is to attach a bent-housing or a bent-sub downhole drilling motor to the end of the drilling string as a steering tool.

Directional drilling may also be accomplished with a "rotary steerable" drilling system wherein the entire drill pipe string is rotated from the surface, which in turn rotates the bottomhole assembly, including the drilling bit, connected to the end of the drill pipe string. In a rotary steerable drilling system, the drilling string may be rotated while the drilling tool is being steered either by being pointed or pushed in a desired direction (directly or indirectly) by a steering device. Some rotary steerable drilling systems include a component which is non-rotating relative to the drilling string in order to provide a reference point for the desired direction and a mounting location for the steering device(s).

As a third option, directional drilling may be accomplished using a combination of both rotary steerable drilling and sliding drilling. Rotary steerable drilling will typically be performed until such time that a variation or change in the direction of the wellbore is desired. Rotation of the drill pipe string is then stopped and sliding drilling, through use of the downhole motor, is commenced. Although the use of a combination of sliding and rotary drilling may permit satisfactory control over the direction of the wellbore, many of the problems and disadvantages associated with sliding drilling are still encountered.

BRIEF DESCRIPTION OF THE DRAWINGS

Implementations of the present technology will now be described, by way of example only, with reference to the attached figures, wherein:

FIG. 11A is a diagram illustrating a portion of the bend angle sensing assembly according to the present disclosure at a first angle a;

FIG. 12A is a diagram illustrating an overhead view of a portion of a bend angle sensing assembly according to the present disclosure at a first angle a;

Figure 1:
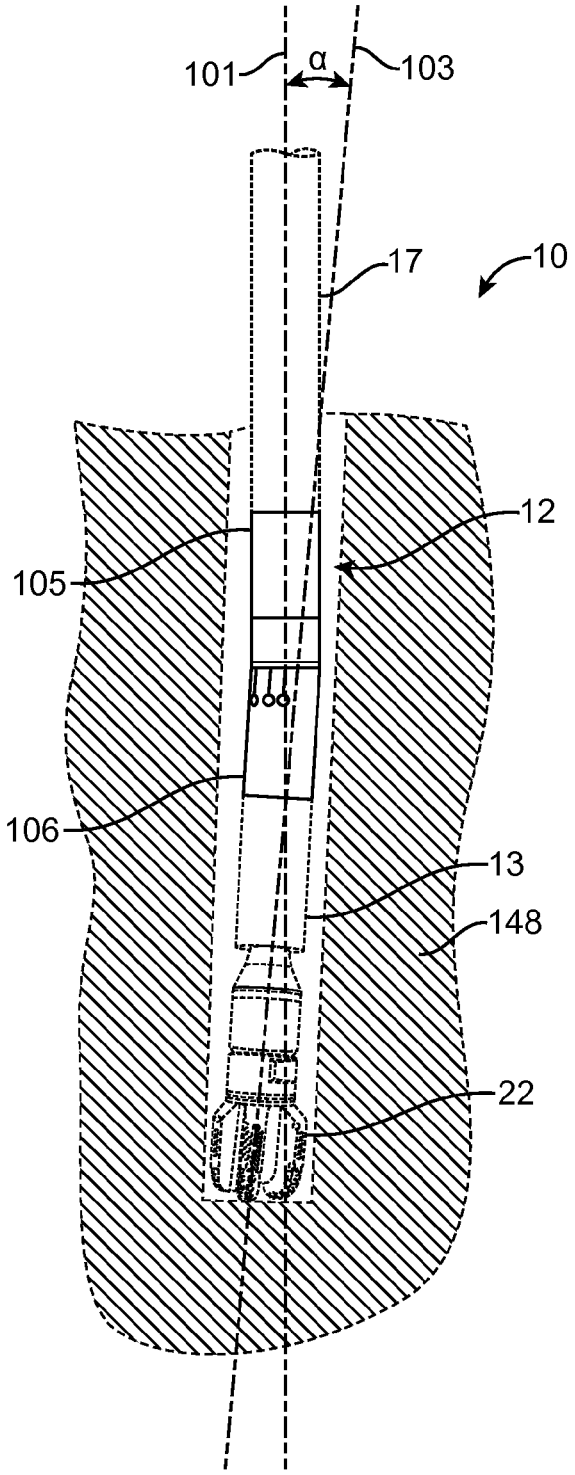
FIG. 1 is a diagram illustrating one example of a directional drilling device with a mud motor in a downhole subterranean environment.

It should be understood that the various embodiments are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connection can be such that the objects are permanently connected or releasably connected. The term "outside" refers to a region that is beyond the outermost confines of a physical object. The term "axially" means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but not necessarily be limited to the things so described.

A directional drilling device is employed to direct drilling towards a desired target destination as well as maintain drilling within a desired payzone, or to correct for unwanted or undesired deviations from a desired or predetermined path. Frequent adjustments are often necessary during drilling, either to accommodate a planned change in direction or to compensate for unintended or unwanted drilling changes. In order to better control and ascertain drilling device direction, it is helpful to determine the drilling angle of a drilling device.

Accordingly, disclosed herein is a directional drilling device assembly having a flow diverter and drilling fluid passageways for determining the downhole bend angle of a drilling device. The directional drilling devices disclosed herein can include a rotatable drill bit that is attached to the distal end as well as a bent housing for pointing the drilling device in the desired direction. The bent housing generally angularly offsets one section of the drilling device relative another section to obtain a particular bend angle such that the direction of the drilling device changes as it progresses during drilling.

Bent housings can be employed in drilling devices driven by a mud motor. In such mud motor drilling devices, drilling fluid, also known as mud or drilling mud, is provided to drive the motor. The mud motor includes a rotor and stator contained within a housing. The flow of mud causes rotation of the rotor within the stator thereby driving the drill bit. Such mud motor drilling devices can have little to no electronics for drilling or carrying out direction changes, rather, pressure and flow control of the drilling fluid is often employed. However, even with the inclusion of electronics or electromechanical devices, fluid can still be passed through a portion of the drilling device whether for driving a motor, cleaning the drill bit or providing lubrication internal and/or external to the drilling device, or for other functions.

With the flow of fluid, a fluid diverter can be employed to change or divert the flow of fluid within the drilling device. As disclosed herein, as the bent housing is adjusted to various angles, the fluid diverter diverts the flow of fluid to within various selectable flow path configurations depending on the bend angle of the bent housing. Pressure and flow rate sensors can be employed to determine flow pressure and flow rate in the fluid source or flow channels. The flow rate and pressure can also be determined from the surface as drilling progresses and drilling fluid is pumped down the drill string by pumps. Accordingly, by determining the changes in pressure and fluid flow rate as a result of adjustment of the bent housing, the bend angle can be determined. Although mud motors and bent housing are illustrated herein, any directional drilling device having an assembly with a flow diverter and fluid flow can be used for determining bend angle.

Referring to FIG. 1 there is shown an illustrative environment in which a mud motor with a bent housing can be implemented. In particular, a directional drilling device 10 is shown within a subterranean formation 148. The directional drilling device 10 has a drill bit 22 for drilling through the formation 148 as well as a mud motor 17 for driving rotation of the drill bit. In order to turn or change direction of the drilling device, an adjustable bent housing 12 is provided along with bearing assembly 13. As illustrated, the bent housing 12 is located between the drill bit 22 and the mud motor 17.

As shown there is a first section 105 having axis 101 and a second section 106 having axis 103, which are separated by the bent housing 12. Upon actuation of the bent housing 12, the first section 105 is angularly offset from section 106 by a bend angle a. With this "bending" of the housing, the direction of drilling will be changed. Although only one bend angle is illustrated in FIG. 1, as is further disclosed herein, the drilling device 10 can be adjusted to several different bend angles. As will be described further below, disclosed herein is a bend angle sensing assembly for determining the bend angle of the adjustable bent housing.

Figure 2:
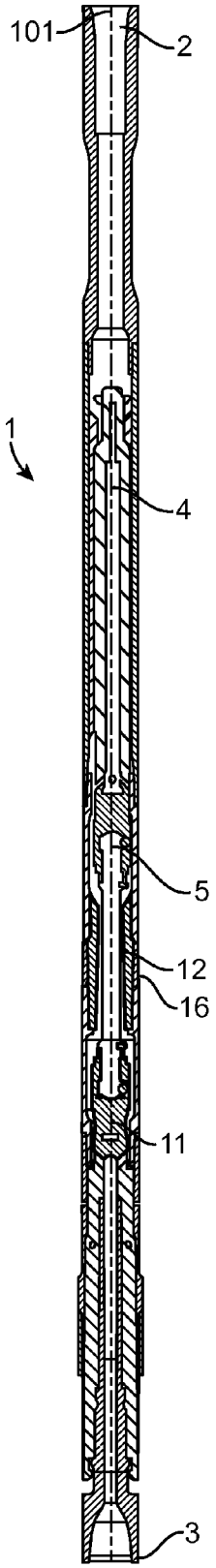
FIG. 2 is a diagram illustrating a portion of a drill string having a bend angle sensing assembly according to one embodiment of the present disclosure.

Illustrated in FIG. 2 is a cross-sectional view of a directional drilling device 1 having a bend angle sensing assembly for determining a bend angle. In particular, the directional drilling device 1 has an upper connection 2 for connecting to a drill string or other tool as well as a lower connection 3, which can include a drill bit, or additional drill string tools. The drilling device 1 includes a power source 4, which in the illustrated embodiment is a mud motor. However, in other examples, any power source can be employed including electrical, fluid or hydraulic power sources. At the lower end of the power source 4 is a constant velocity ("CV") joint assembly 5 coupling the power source 4 with the bent housing 12. This permits transfer of rotation in view of the bending carried out by the bent housing 12.

The adjustable bent housing can be actuated to bend the directional drilling device 1 to a particular bend angle as described with respect to FIG. 1 above. The bend location in the adjustable bent housing 12 is at or near the adjustment ring 16. Rotation of the adjustment ring 16 causes different sections of the bent housing 12 to rotate relative one another to form a particular bend angle. The adjustment ring 16 can be rotated to varying positions, where the bend angle is different at each position. In order to determine the varying bend angles, the bend angle sensing assembly 11 is provided and coupled to the lower portion of adjustable bent housing 12. An exemplary bent housing is illustrated in FIG. 3.

Figure 3:
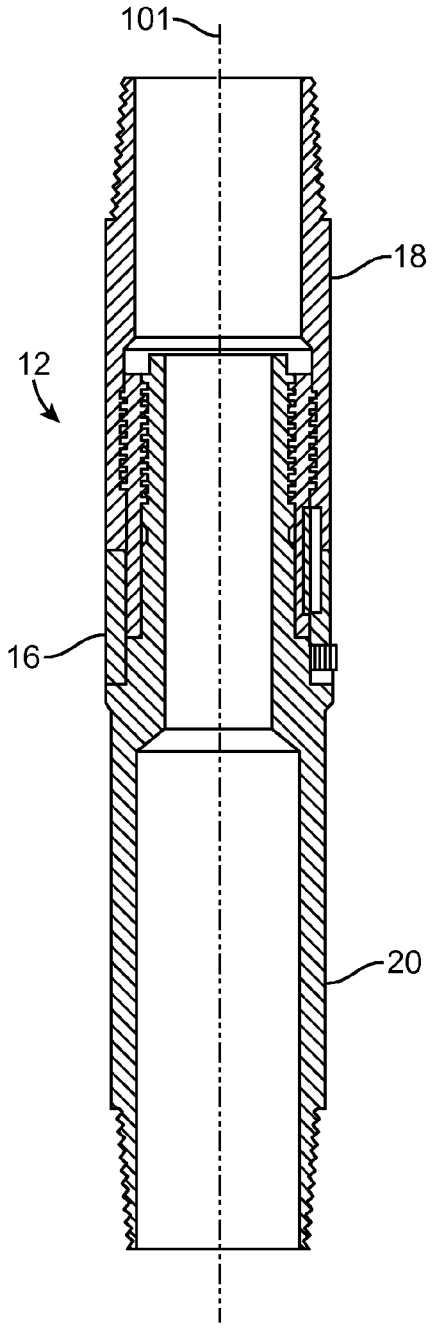
FIG. 3 is a diagram illustrating one example of a bent housing at zero offset (no angle) according to the present disclosure.
Figure 4:
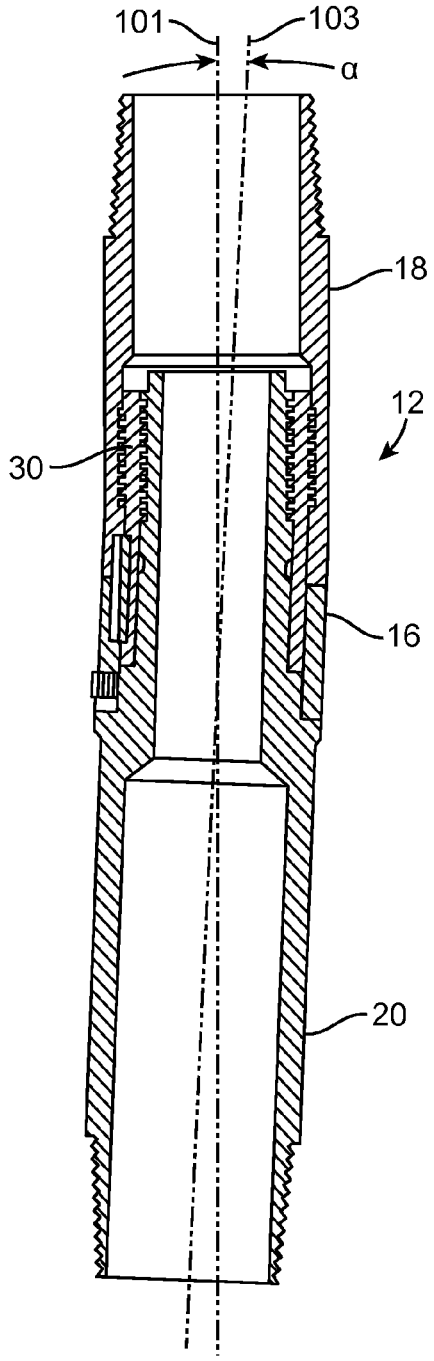
FIG. 4 is a diagram illustrating one example of a bent housing at an angle according to the present disclosure.

As seen in FIG. 3, there is depicted bent housing 12 at zero angular offset (no angle). In particular, the upper body member 18 and lower body member 20 are rotationally aligned internally and externally in the neutral position. The body members 18, 20 have a central bore to allow passage of the mud motor shaft and drilling fluid (i.e., mud) therethrough. An eccentric sleeve 30 is also provided threaded between the body members 18, 20, and fixed to the adjustment ring 16. Although adjustment ring 16 is illustrated as having gears in FIG. 3, the adjustment ring can be rotated by other means, for example a shaped groove (discussed in FIG. 5 below). Upon rotation of the adjustment ring 16, the upper body member 18 becomes offset both internally and externally relative to lower body member 20. Accordingly, the central axis 101 of body member 18 is rotationally processional about the bend axis 103 of the body member 20. As shown in FIG. 4, with full rotation of the adjustment ring 16, the central axis 101 of body member 18 is offset by the bend angle a due to the positioning of the eccentric sleeve 30. Other bend angles may also be obtained by rotating the adjustment ring 16 to other positions. For example, if bend angle a is achieved by full rotation, alternative bend angles may be achieved by rotating the adjustment ring at ⅓ turns, thus permitting three bend angles for example. However, there can be any number of bend angle settings can be obtained by corresponding rotation of the adjustment ring 16.

Figure 5:
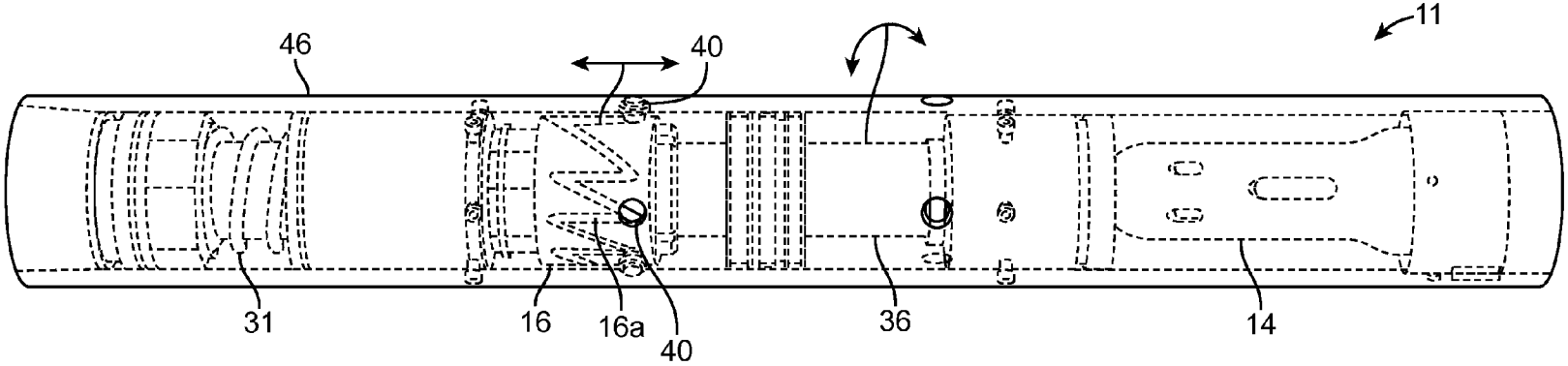
FIG. 5 is a diagram illustrating a bend angle sensing assembly coupled to a downhole adjustable bent housing according to the present disclosure.

FIG. 5 depicts a bend angle sensing assembly 11 according to one embodiment of the present disclosure and which is incorporated into directional drilling device 1 described above with respect to FIG. 2. The adjustment ring 16 is shown on the left side of the figure (i.e., upwards toward the surface), and is fixedly attached to shaft 36. The adjustment ring 16 can have a groove 16*a*, which is provided on the surface of the adjustment ring in a zig-zag fashion. Projections 40 fixedly extend from the outer housing 46 and into the groove 16*a*. In order to rotate the adjustment ring 16, a power source (not shown) can urge the adjustment ring 16 longitudinally towards the left side of the figure (i.e., upwards toward the surface). Due to the projections 40 extending into the groove 16*a*, as the adjustment ring 16 moves longitudinally it will rotate correspondingly to the shape of the groove. With rotation of the adjustment ring 16, the bend angle sensing assembly 11 can then bend to varying bend angles as discussed with respect to FIGS. 3-4 so as to change the direction of drilling. Subsequently, the biasing member 31 can urge the adjustment ring 16 back to its original position, thus causing the adjustment ring 16 to rotate to its original position and the bend angle to return to zero (i.e., neutral).

The adjustment ring 16 is fixedly connected to a flow diverter 14 via the shaft 36. Due to a fixed connection, with rotation of the adjustment ring 16, the flow diverter 14 also rotates. The flow diverter 14 can be used to divert the flow of drilling fluid (also referred to as "mud") passing through the directional drilling device 1. The flow diverter 14 changes the passage of the fluid directing it to different portions of the drilling device 1 via various flow paths. The flow diverter can also be referred to as a variable choke, as it "chokes" or obstructs the flow of drilling fluid to various flow paths depending on its position. One example of a flow diverter 14 is shown for example in FIG. 6.

Figure 6:
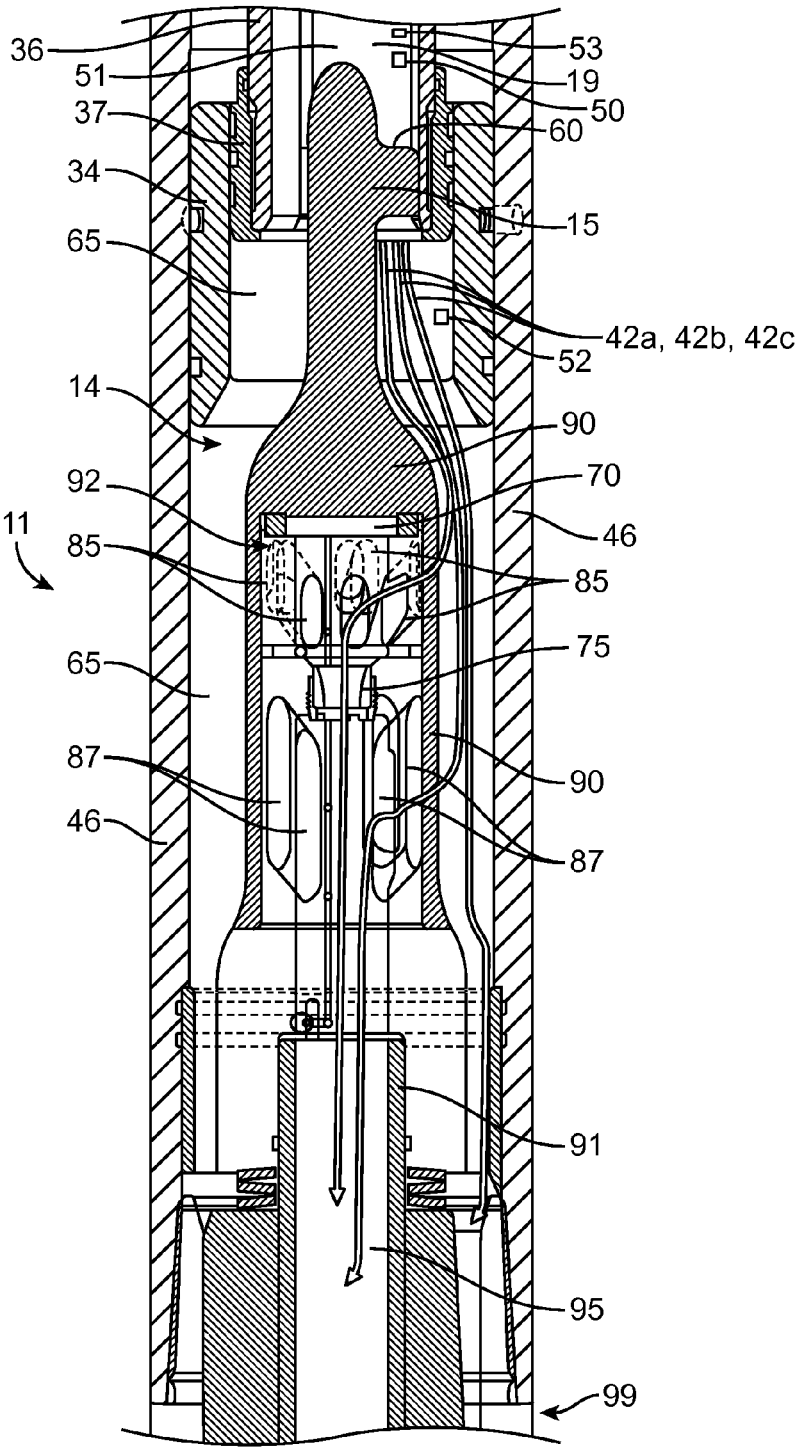
FIG. 6 is a diagram illustrating several exemplary flow paths of a bend angle sensing assembly according to the present disclosure.

FIG. 6 illustrates the bend angle sensing assembly 11 having flow diverter 14. The head portion 15 of flow diverter 14 is fixedly coupled within and to the shaft 36 for rotation therewith. For example, the flow diverter 14 has splines 60 which engage the interior of the shaft 36. Accordingly, when the shaft 36 rotates, the flow diverter 14 correspondingly rotates. The shaft is fixed to inner stabilization member 37 which rotates along with the shaft 36. The outer stabilization member 34 remains fixed to the housing 46. Therefore, the shaft 36, diverter 14 and inner stabilization member 37 rotate together relative outer stabilization member 34 and housing 46.

In particular, a drilling fluid passes through central bore 51 around the head 15 and body of diverter 14. The drilling fluid then passes to and fills the annulus 65 between the housing 46 and the diverter 14 as it flows downward toward the distal end 99 of the bend angle sensing assembly 11. This drilling fluid can be considered a fluid source 19 as it is provided from above the diverter 14 toward the lower portion. The drilling fluid can take a number of discrete flow paths 42*a*, 42*b*, and 42*c* (represented by arrows) which depend on the orientation of the diverter 14. In particular, as the diverter 14 rotates, the drilling fluid is diverted to one of a plurality of particular flow path configurations down one or more of the flow paths 42*a*, 42*b*, and 42*c*. The drilling pressure of the drilling fluid in the central bore 51 and annulus 65 changes for each configuration, and thus each configuration has a distinct corresponding or associated pressure at a particular flow rate. By determining the particular configuration of flow paths, the orientation of diverter 14 can be determined, as well as the bend angle of the bent housing 12.

As noted above, due to the fixed connection between the diverter 14, the shaft 36, and adjustment ring 16, the orientation of diverter 14 relates to and is dependent on the rotation and orientation of the adjustment ring 16. The orientation of the adjustment ring 16 also affects and controls the bend angle of the bent housing 12. Therefore, the bend angle of the bent housing 12 is correspondingly related to the orientation of the diverter 14. The orientation of the diverter 14 affects also the configuration of flow paths of the drilling fluid. Therefore, the configuration of flow paths is linked directly to the particular bend angle of the bent housing 12. Consequently, by determining the configuration of flow paths of the drilling fluid the bend angle of the bent housing 12, can be determined.

One way to determine the configuration of the flow paths is by measuring the pressure of the drilling fluid in the central bore 51 or annulus 65, referred to herein also as back pressure. The pressure change is a result of a change in the flow area during rotation of the diverter 14. Within the diverter 14 is contained a non-rotating flow receiver 92. In particular, while diverter 14 rotates, the receiver 92 stays in a fixed position. A bearing 70 is provided at the top of the receiver 92 in its connection to diverter 14 to permit rotation of the diverter 14 relative the receiver 92. The flow receiver 92 has a set of set of narrow apertures 85 as well as broad apertures 87. The diverter 14 has side wall 90 which block access of the drilling fluid from the annulus 67 to one or both of the narrow or broad apertures 85, 87. Upon rotation of the diverter 14, the side wall rotates around the receiver 92, and apertures in the side wall 90 of the diverter align with one or both of the narrow or broad apertures 85, 87. With the apertures unaligned, the drilling fluid is blocked from entering within the diverter 14 and resides in only the annulus 65 around the diverter 14. Accordingly, the annulus 65 will have a particular pressure when no drilling fluid is being diverted into the diverter 14. However, when the apertures align, new flow paths open and a portion of the drilling fluid is diverted into the narrow and/or broad apertures 85, 87. As a consequence, the area of flow is increased thereby changing the pressure in the annulus 65. After entering the receiver 92, the drilling fluid passes to the pipe bore 95 of the standpipe 91 to the distal end 99 of the bend sensing assembly 11. When drilling fluid passes through the narrow apertures 85, the drilling fluid additionally passes through flow restrictor 75 prior to entering the pipe bore 95, further increasing back pressure.

Accordingly, each particular flow configuration has a different flow area, resulting in a different pressure at a given flow rate. Therefore, as there is a direct relationship between flow rate and an expected pressure for each flow path configuration, with knowledge of the pressure and flow rate, the particular flow configuration may be determined.

The pressure and flow rate can be determined any number of ways. As shown in FIG. 6 for example, a bore pressure sensor 50 may be provided in the central bore 51 for measuring the pressure of the drilling fluid (e.g., fluid source 19) of the shaft 36. An annulus pressure sensor 52 can also be provided in the annulus 65 for measuring fluid pressure. The pressure sensors 50, 52 can be for example a transducer or other pressure measuring device. A flow rate sensor 53 can be provided to determine the flow rate of the mud passing through the assembly. While sensors can be employed within or near the bend sensing assembly, electronics may also be avoided and communication of pressure difference communicated to the surface via a fluid circuit, i.e., a path of fluid going to the surface where the pressure changes and flow rate can be detected. This is due to the drilling fluid being in fluid communication throughout the drill string from the bend angle sensing assembly 11 and shaft 36 to the surface where drilling fluid is provided. Alternatively, the pressure and flow can be communicated to surface via wire or wireless transmission, or other methods. Additionally, or alternatively, pressure sensors and flow rate sensors can provided at the surface, and/or for example pumps can be employed to determine and control pressure and flow rate. Accordingly, pressure sensors herein can include the sensors 50, 52 within the bend sensing assembly, as well as sensors at the surface, or other equipment, such as pumps, that can detect or determine pressure. By determining the pressure and flow rate an operator at the surface or a controller can determine which flow channel had been used as well as the corresponding bend angle.

Figure 7:
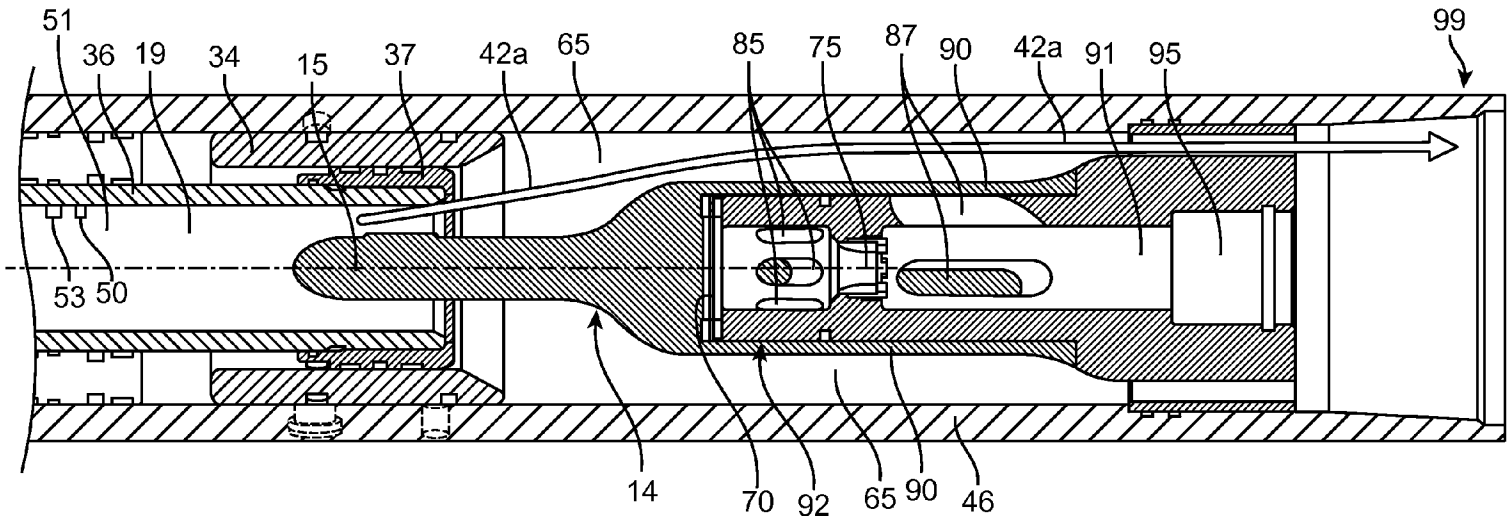
FIG. 7 is a diagram illustrating a flow path configuration for a bend angle at zero offset according to the present disclosure.

Several flow path configurations are discussed in the following FIGS. 7-9. For example, a first flow path configuration, or unbent flow path configuration is shown in FIG. 7. For example, if the bent housing 11 has a zero bend angle, and the adjustment ring 16 is in its original non-rotated configuration, the flow path configuration may have that shown in FIG. 7. In this flow path configuration also, the diverter 14 is in its original non-rotated position.

As shown in FIG. 7, the drilling fluid passes from the central bore 51 to the annulus 65 following flow path 42*a*, indicated by the arrow. The diverter 16 is oriented such that the side wall 90 block flow of the drilling fluid from the annulus 65 to either of the plurality of apertures 85 or 87. Therefore, flow is constrained only to the outside of diverter 14. With this particular flow path configuration, the drilling fluid has a particular pressure at a given flow rate. Accordingly, with knowledge of the pressure and flow rate of the drilling fluid, an operator or controller may determine the flow configuration is that shown in FIG. 7, and that the bent housing 12 had zero bend angle. In order to determine the pressure indicative of the flow rate in FIG. 7, prior testing could be conducted to relate the bend angle to the flow path configuration. The bend angle can then be determined by the operators manually or by use of a controller along the drill string or at the surface.

Upon rotation of the adjustment ring 16, the bent housing 12 is adjusted to a first bend angle. With rotation of the adjustment ring 16, the diverter 14 is also rotated and diverts the flow of drilling fluid according to the flow path configuration shown in FIG. 8. As shown therein, the diverter 14 is rotated such that an aperture 93 in the side wall 90 becomes aligned with an aperture 87 of the flow receiver 92. In additional examples, there can be multiple apertures 93 in the side wall 90 that align with multiple apertures 80. Accordingly, with alignment of the apertures 87 and 93, the flow path 42*b* is opened such that a portion of the drilling fluid is diverted from the annulus into the diverter 14. The drilling fluid can then pass into the pipe bore 95 of standpipe 91 into the distal end 99 of the sensing assembly 11.

With flow path 42*b* opened and drilling fluid diverted to within receiver 92, along with flow path 42*a* (the drilling fluid shown as 42 coming from central bore 51), the total flow area increases. Accordingly, with increased flow area, the drilling fluid has a corresponding pressure decrease. With the pressure decrease detected by pressure sensors 50, 52 or detected at the surface, along with the flow rate, an operator or controller can determine the flow path configuration as shown in FIG. 8 has been set, thereby indicating the bent housing 12 has been adjusted to a first bend angle.

Upon further rotation of the adjustment ring 16 to a second rotated orientation, the bent housing 12 is adjusted to a second bend angle. The diverter 14 is correspondingly rotated with the adjustment ring 16 to divert the flow of drilling fluid according to the flow path configuration shown in FIG. 9. As shown therein, the diverter 14 is rotated such that an aperture 94 in the side wall 90 becomes aligned with an aperture 85 of the flow receiver 92. In additional examples, there can be multiple apertures 85 in the side wall 90 that align with multiple apertures 80. Accordingly, with alignment of the apertures 85 and 94, the flow path 42*c* is opened such that a portion of the drilling fluid is diverted from the annulus into the diverter 14. The drilling fluid can then pass into the pipe bore 95 of standpipe 91 into the distal end 99 of the sensing assembly 11.

With flow path 42*c* opened and drilling fluid diverted to within receiver 92, the drilling fluid can pass through a flow restrictor 75 prior to entering the pipe bore 95. Upon opening of flow path 42*c*, the total flow area changes as compared to the flow path configuration in FIG. 7 or 8. Accordingly, with a change in the flow area, along with the effects of flow restrictor 75, the drilling fluid has a corresponding pressure change. For example, the pressure may change to a pressure intermediate between the configurations where 42*a* is the only path as in FIG. 7 or where paths 42*a* and 42*b* are open as in FIG. 9. With the pressure decrease detected by pressure sensors 50, 52 or detected at the surface, along with the flow rate, an operator or controller can determine the flow path configuration as shown in FIG. 9 has been set, thereby indicating the bent housing 12 has been adjusted to a second bend angle.

Figure 8:
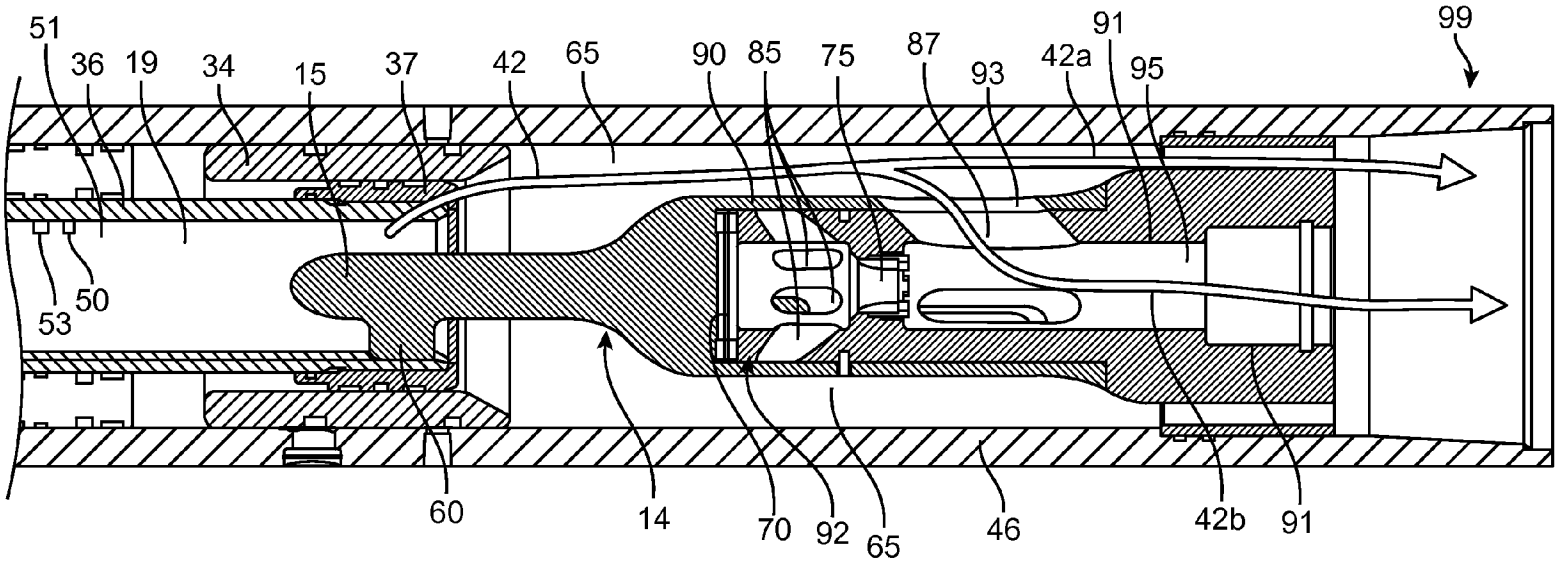
FIG. 8 is a diagram illustrating a flow path configuration for a bend angle at a first bend angle according to the present disclosure.
Figure 9:
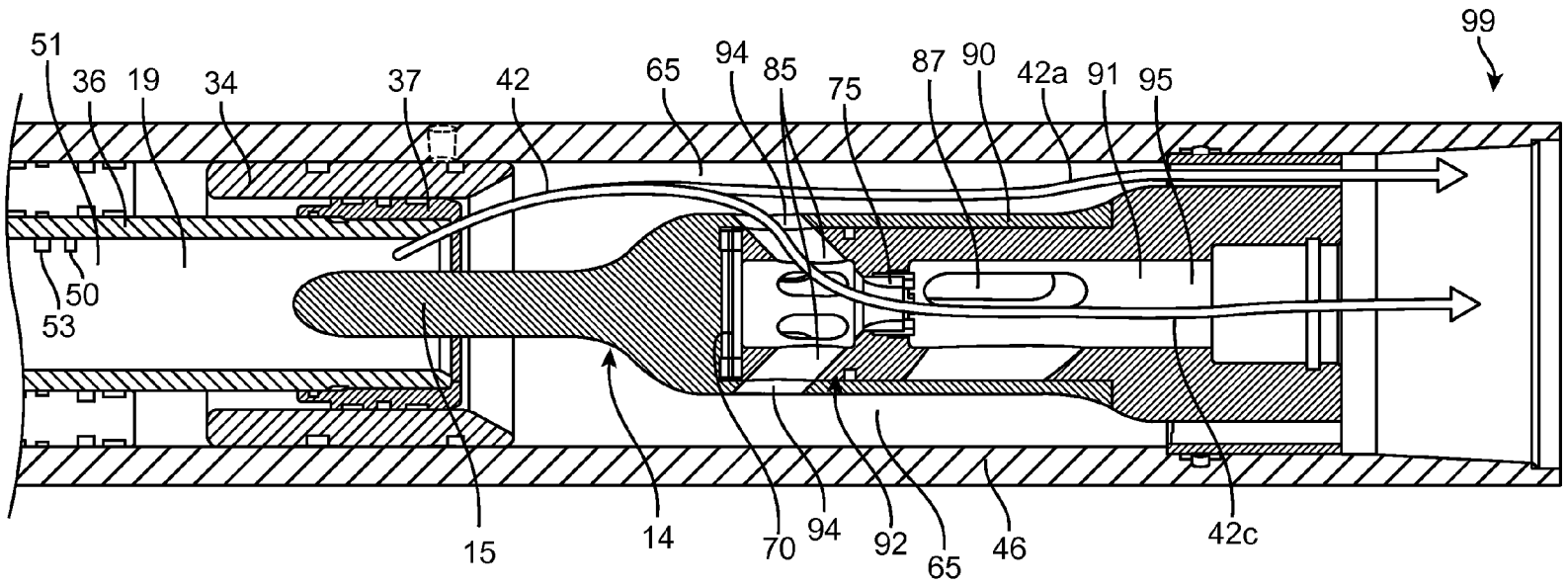
FIG. 9 is a diagram illustrating a flow path configuration for a bend angle at a second bend angle according to the present disclosure.

Based on the exemplary embodiments shown in FIGS. 7-9, the bent housing 12 can take on any of the three different settings. For example, if the bent housing 2 is straight, e.g. zero bend angle, the flow path configuration may be that shown in FIG. 7, where drilling fluid flows around the diverter in the annulus 65 as illustrated by flow path 42*a*. An operator or controller can determine that there is zero bend angle by the back pressure detected within the bend sensing assembly 11 or at the surface. When the bent housing 12 is adjusted to a first bend angle, the back pressure changes as the drilling fluid is diverted by diverter 14 to flow paths 42*a* and 42*b* with the flow path configuration as shown in FIG. 8. Due to the larger area for flow of the drilling fluid, the pressure would decrease as a result. The new drilling fluid pressure can be detected by pressure sensors 50, 52 or at the surface to indicate the bent housing has taken on the first bend setting. The bent housing 12 can then be adjusted to a second bend angle larger than the first bend angle. As a result, the drilling fluid is diverted by diverter 14 to flow paths 42*a* and 42*c* with the flow path configuration as shown in FIG. 9. Due to the change in flow area, as well as passage of flow path 42*c* through flow restrictor 75, the pressure of the drilling fluid is different than in flow path configurations of FIGS. 7 and 8. Accordingly, this drilling fluid pressure can be detected by pressure sensors 50, 52 or at the surface to indicate the bent housing has taken on the first bend setting.

Although three bent housing positions are discussed, along with three associated flow path configurations, there can be any number of bend angles and associated flow path configurations. For example, there may be two bend configurations, 3, 4, 5, 6, 7, 8, 9, 10, 11, 12, 13, 14, or any plurality of bend configurations and corresponding flow path configurations. For example, additional apertures can be provided in the diverter 14 and the receiver 92 than those shown in FIGS. 7-9, to accommodate to a different flow areas which affect back pressure. Accordingly, for every rotational position of the adjustment ring 16 and associated bend angle, there is a corresponding flow path configuration and associated pressure.

Alternative examples for determining bend angle based on drilling fluid pressure are shown in FIGS. 10-12D. In FIGS. 10-12D the drilling fluid flow paths are defined by discrete fluid flow channels, which may be for example tubes, or other enclosures. In these examples, diverter 14 is provided with fluid flow channels 142*a*, 142*b*, and 142*c*. Between the shaft 36 and the annulus 65 is a barrier 700 preventing flow of fluid from fluid source 19. Drilling fluid is provided in the central bore 51 of the shaft 36 which passes through fluid flow inlets 143*a*, 143*b*, 143*c* to the fluid flow channels 142*a*, 142*b*, and 142*c*.

Figure 10:
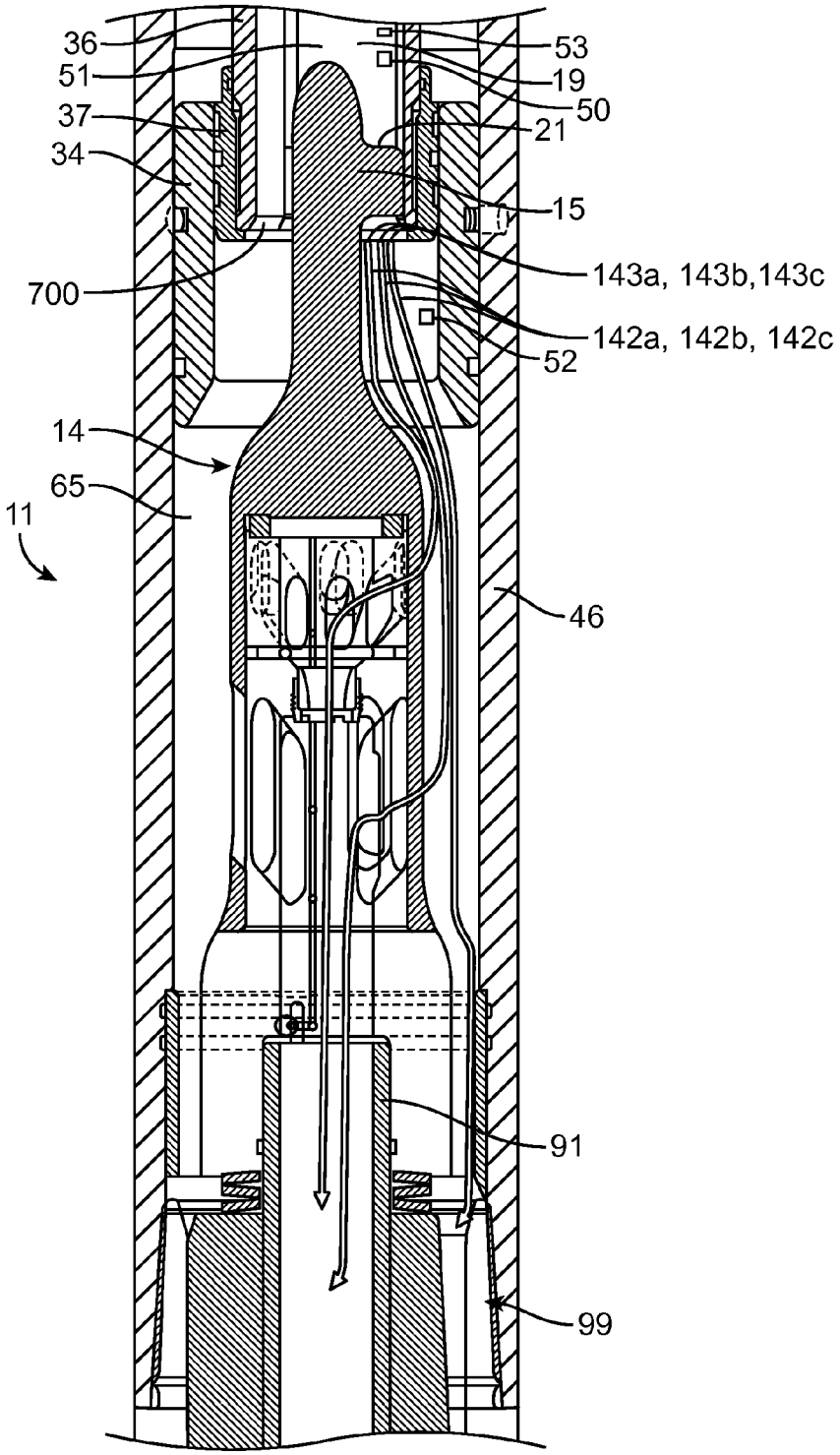
FIG. 10 is a diagram illustrating a portion of the bend angle sensing assembly according to the present disclosure at zero offset.

In particular, in FIG. 10, the flow diverter 14 includes a plurality of differently configured diversion flow channels 142*a*, 142*b*, and 142*c*, each having a selectable fluid flow inlet 143*a*, 143*b*, 143*c*, placeable in fluid communication with fluid flow source 19 in dependence upon the particular bend angle of the associated adjustable bent housing 12. In particular, upon rotation of the adjustment ring 16, the flow diverter 14 also rotates, thereby uncovering, or opening, the inlets inlet 143*a*, 143*b*, 143*c* depending on the degree of rotation. Accordingly, for each rotational position of the adjustment ring 16, which also corresponds to different bend angles, a different configuration of flow channels 142*a*, 142*b*, and 142*c* will be opened. The flow channels 142*a*, 142*b*, and 142*c* can differ in size, i.e., flow cross-sectional area. This can result in a different backpressure in the fluid source 19 corresponding to which of the channels the drilling fluid is diverted by the rotation of the flow diverter 14. Accordingly, by measuring the back pressure in the fluid source 19, along with the flow rate, the bend angle can be determined. Additionally, or alternatively, the pressure of flow channels 142*a*, 142*b*, and 142*c* themselves can be measured to determine which flow channels had pressure change (increase or decrease). When pressure drops in a channel, this can indicate that fluid was diverted away from that channel. Whereas, if pressure is maintained or increased in a flow channel, this can indicate that fluid was diverted to that channel. Accordingly, by measuring which configuration of channels have fluid diverted thereto, the bend angle can be determined.

Therefore, in order to determine pressure of the fluid source 19, pressure sensors can be employed. For example, a bore pressure sensor 50 can be used. The bore pressure sensor 50 can be positioned to measure the pressure of the fluid source 19, and thus proximate the central bore 51, or the source pressure sensor 50 can be at the surface, or anywhere along the drilling string in communication with the drilling fluid. For example, during ordinary drilling with the mud motor, drilling fluid is supplied along the drilling string at a particular pressure.

By diverting the flow with the diverter 14, depending on the cross-sectional flow area of the flow channels, the back pressure is changed. When flow is diverted to larger flow channels (or more flow channels), the back pressure is decreased corresponding to the flow area of the channel. This change in backpressure is indicative of which flow channels were actuated, and thus indicative of the bend angle. Additionally, a flow rate sensor 53 can be provided to determine the flow rate of the mud passing through the assembly. Such flow rate sensor 53 can be provided within the fluid source 19 or at the surface where drilling fluid is injected. Therefore, by determining the pressure and flow rate an operator or a controller can determine which flow channel had been used as well as the corresponding bend angle.

Additionally, or alternatively, one more channel pressure sensor(s) 52 can be employed to measure the pressure of each of the flow diversion channels 142*a-c*. This enables determination of which of the plurality of differently configured flow diversion channels 142*a-c* is experiencing fluid flow. The determination of bend angle based on the flow within flow diversion channels 142*a*, 142*b*, and 142*c* is discussed in more detail in FIGS. 11-11C.

Figure 11:
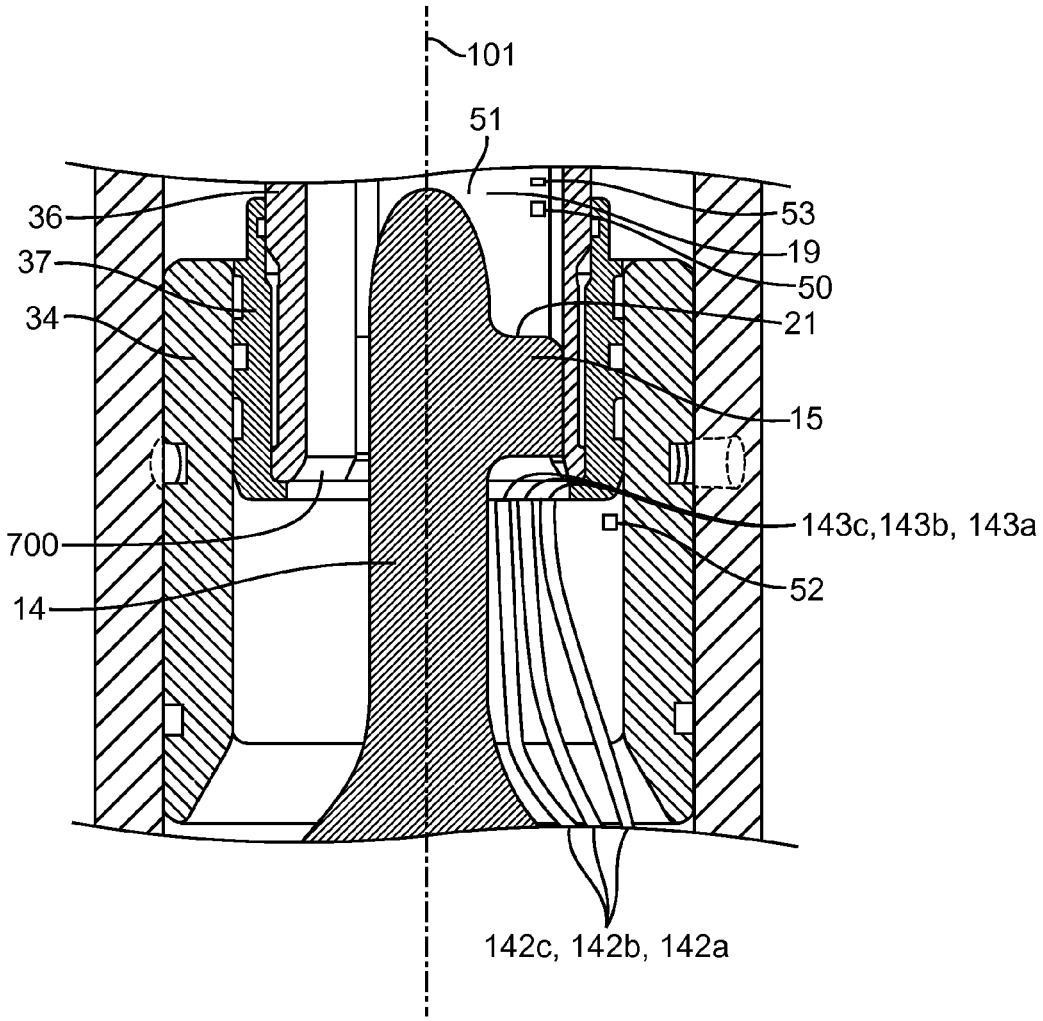
FIG. 11 is a diagram illustrating a portion of the bend angle sensing assembly according to the present disclosure.
Figure 11A:
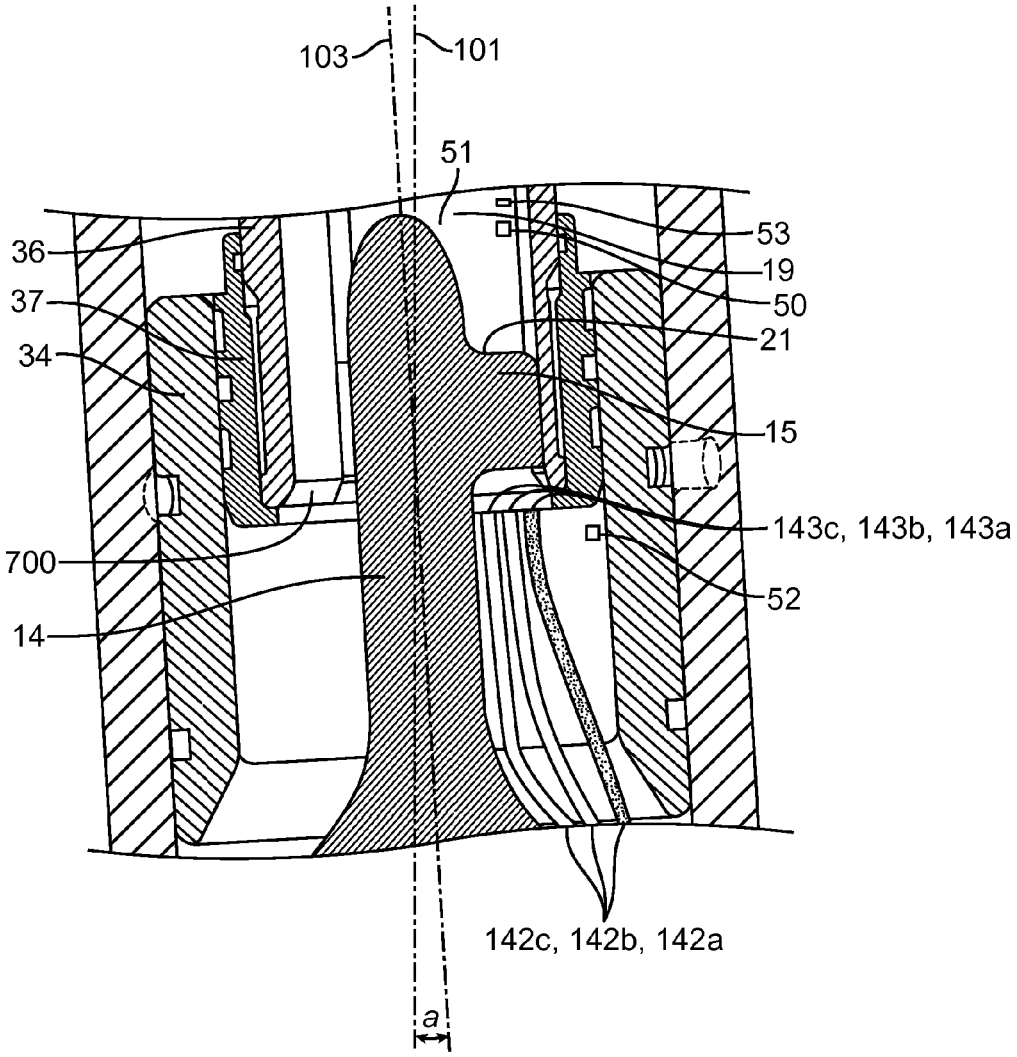
Figure 11B:
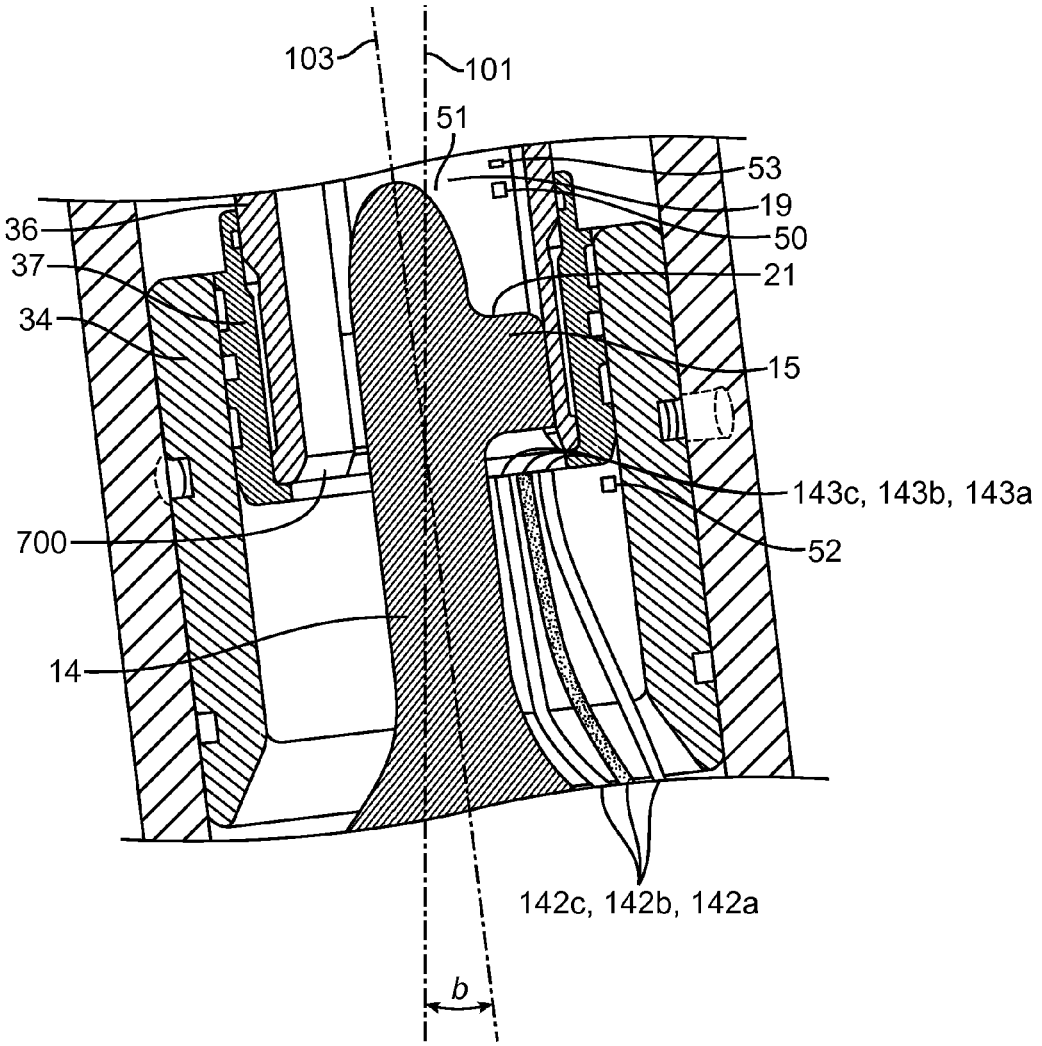
FIG. 11B is a diagram illustrating a portion of the bend angle sensing assembly according to the present disclosure at a second angle b.
Figure 11C:
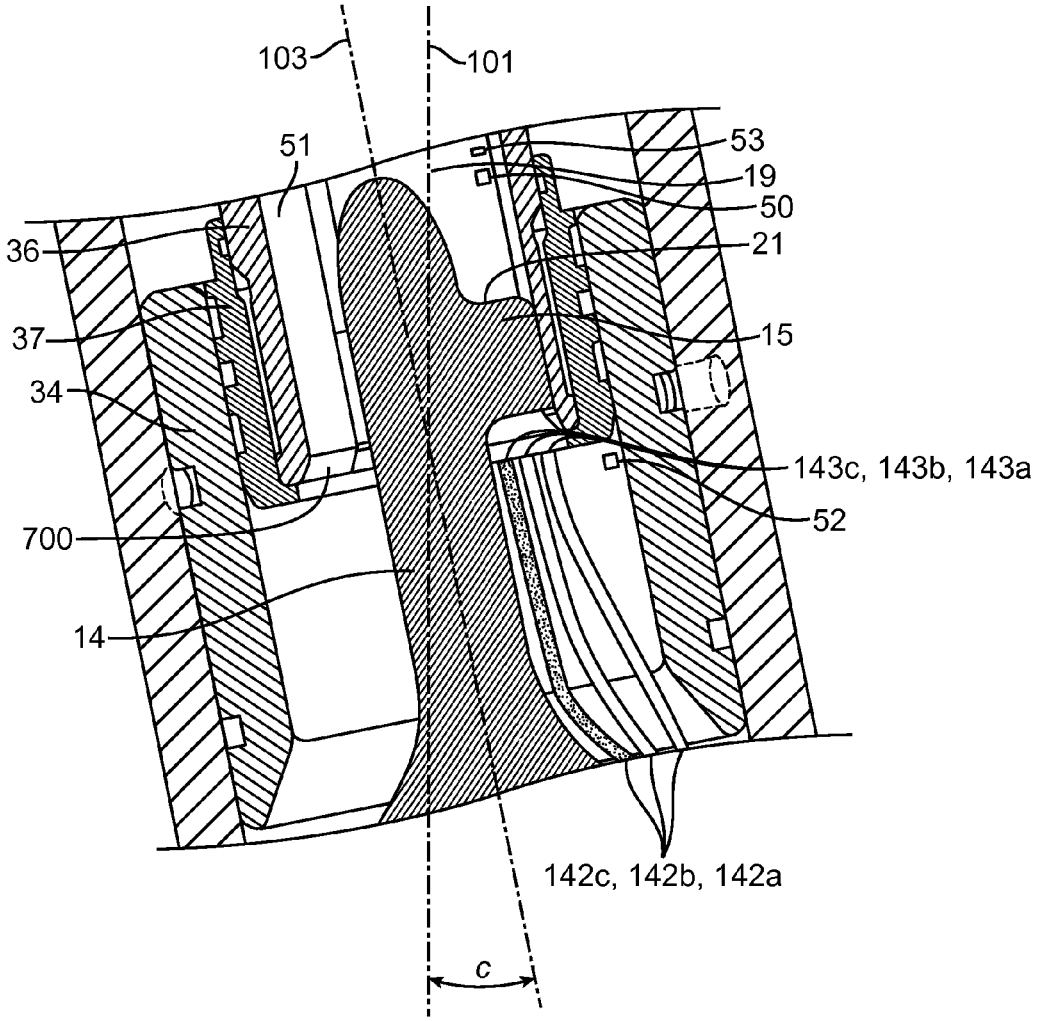
FIG. 11C is a diagram illustrating a portion of the bend angle sensing assembly according to the present disclosure at a third angle c.

FIG. 11 and FIGS. 11A-11C illustrate an exploded cross sectional view of a portion of a bend angle sensing assembly 11 including the flow diverter 14. Shown are the plurality of flow channels 142*a*, 142*b*, and 142*c*, each having a selectable fluid flow inlet 143*a*, 143*b*, 143*c*. Notably, because in the illustrated example, the flow diverter is located below the bent housing and adjustment ring 16, the flow diverter 16 is within the portion of the assembly which will be at an angle with respect to the portion above the bent housing. Therefore, as shown in these FIGS. 11A-11C, axis 103 of the flow diverter 14 will be at three different angles with respect to the axis 101 of the drilling device. The bend angles illustrated in FIGS. 11A-11C are exaggerated to show effect.

In FIG. 11, flow diverter 14 is at zero offset, i.e., the adjustable bent angle assembly is neutral, having no bend angle, and is thus in line with the axis 101 of the drilling device. At this zero offset, the adjusting angle 16 is in its original non-rotated position. Exemplified in FIGS. 11A-

11C are three discrete bend settings, each corresponding to one rotational position of the adjustment ring 16.

Initially, in FIG. 11, with a bend angle of zero, the flow diverter 14 blocks drilling fluid from flow source 19 such that none of the flow channels 142*a*, 142*b*, and 142*c* are open and there is no fluid communication with fluid source 19. Accordingly, with these flow channels closed, the pressure in the fluid source 19 would have a particular initial pressure as measured by source pressure sensor 50. Additionally, or alternatively, each of the flow channels 142*a*, 142*b*, and 142*c* would also have initial pressure values as measured by channel pressure sensor 52.

FIGS. 11A-11C show the flow diverter 14 at three different positions, corresponding to three different bend angles, a, b, and c, of the adjustable bent housing. The head 15 has an exit port 21 (shown also in FIGS. 12A-12C) which is selectively placeable in registration with individual inlets 143*a*, 143*b*, and 143*c* to permit flow into the flow channels. At a first rotated position of the adjustment ring 16, FIG. 11A shows the flow diverter 14 offset at a first bend angle a between axis 101 and flow diverter axis 103. At first bend angle a, fluid flow inlet 143*a* becomes engaged with the exit port of the fluid flow source 19 so that fluid flows through to flow channel 142*a*. This is illustrated in FIG. 11A by showing flow channel 142*a* as shaded, whereas 142*b* and 142*c* are unshaded, with shading illustrating increased fluid pressure or flow due to communication of the flow channel with the fluid source 19. The source pressure sensor 50 can sense the change in back pressure in the fluid source 19, thus indicating a change in pressure. Alternatively or additionally, channel sensor 52 can measure the pressure in the channels directly.

As illustrated in FIG. 11B, at a second angle b (greater than angle a), fluid flow inlet 143*b* becomes engaged with the exit port 21 of the fluid flow source 19 so that fluid flows through diversion flow channel 42*b*, while fluid communication with the flow channel 42*a* is closed or blocked. This is illustrated in FIG. 11B by showing flow channel 42*b* as shaded, whereas 142*a* and 142*c* are unshaded, with shading illustrating increased fluid pressure or flow due to communication of the flow channel 142*b* with the fluid source 19. Further, flow channel 142*b* and flow channel 142*a* can have different cross-sectional areas for flow. For example, if 142*b* has a larger cross-sectional area than 142*b*, a greater pressure drop would occur in fluid source 19 as flow is provided to flow channel 142*b* after closure to flow channel 142*a*. This greater pressure drop would indicate a greater bend angle due to rotation of adjustment ring 16 and flow diversion to another flow channel. This difference in pressure then corresponds to the bend angle. The inverse can also be true, where 142*a* has a larger flow area than 142*b*, and therefore, a pressure increase in fluid source 19 would occur and detection of the same by source sensor 50.

As seen in FIG. 11C, at a third (greater than both angle a and angle b), fluid flow inlet 143*c* becomes engaged with the exit port 21 of the fluid flow source 19 so that fluid flows through to diversion flow channel 142*c*. This is illustrated in FIG. 11B by showing flow channel 42*c* as shaded, whereas 142*a* and 142*b* are unshaded, with shading illustrating increased fluid pressure or flow due to communication of the flow channel 42*c* with the fluid source 19. Further, flow channel 142*c* can have a different cross-sectional area for flow as compared to flow channel 142*a* or 142*b*. For example, with flow channel 142*c* larger than 142*b*, which in turn is larger than 142*a*, fluid source 19 would register a larger pressure drop with each increase in bend angle, with the largest pressure drop being that when flow channel 142*c* is open and flow channels 142*a* and 142*b* closed. The inverse can also be true, where flow channel 142*a* has the largest flow cross-sectional area and flow channel 142*c* the smallest. In such case, the pressure in fluid source 19 would increase with each rotation of adjustment ring 16 and fluid diverter 14, and corresponding bend angle. Additionally, or alternatively, the pressure change within the flow channel 142*c* and 142*b* could be detected by channel pressure sensor 52.

Accordingly, each angle a, b, and c, can represent a discrete, predetermined angle at which a corresponding fluid flow inlet 143*a*, 143*b*, and 143*c* engage with fluid flow source 19. Pressure sensors 50, 52 can be communicatively coupled to the fluid flow source 19 or the channels 142*a*, 142*b*, and 142*c* to determine which diversion flow channels is experiencing fluid flow therethrough. With source pressure sensor 50, the backpressure could be transmitted or determined by surface operators and/or the channel pressure sensor 52 can transmit signal indicative of pressure to operators of the drilling operation. The bend angle can then be determined by the operators manually or by use of a controller at the surface. Electronics can be avoided and communication of pressure difference communicated to the surface via a fluid circuit, i.e., a path of fluid going to the surface where the pressure changes and flow rate can be detected. Alternatively, the pressure and flow can be communicated to surface via wire or wireless transmission, or mud pulse or other methods.

Figure 12A:
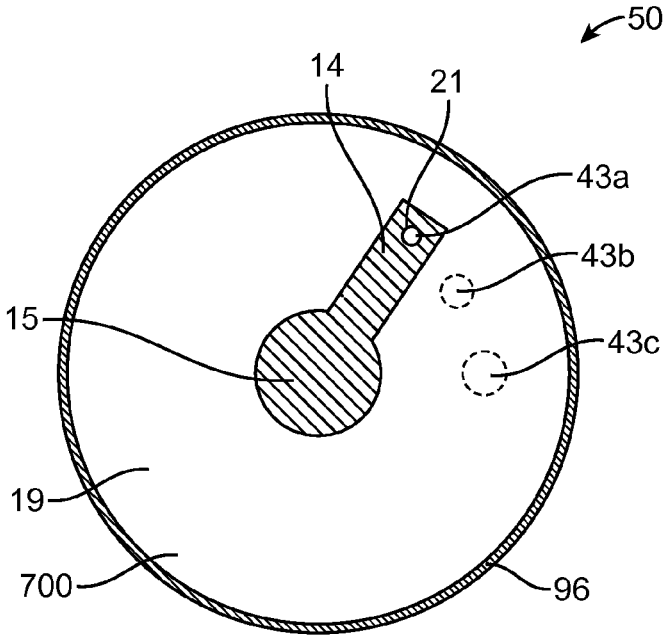
Figure 12B:
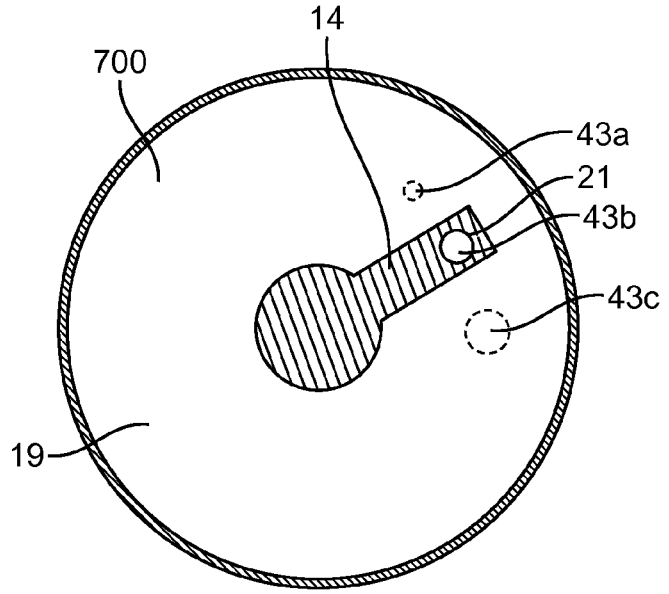
FIG. 12B is a diagram illustrating an overhead view of a portion of a bend angle sensing assembly according to the present disclosure at a second angle b.
Figure 12C:
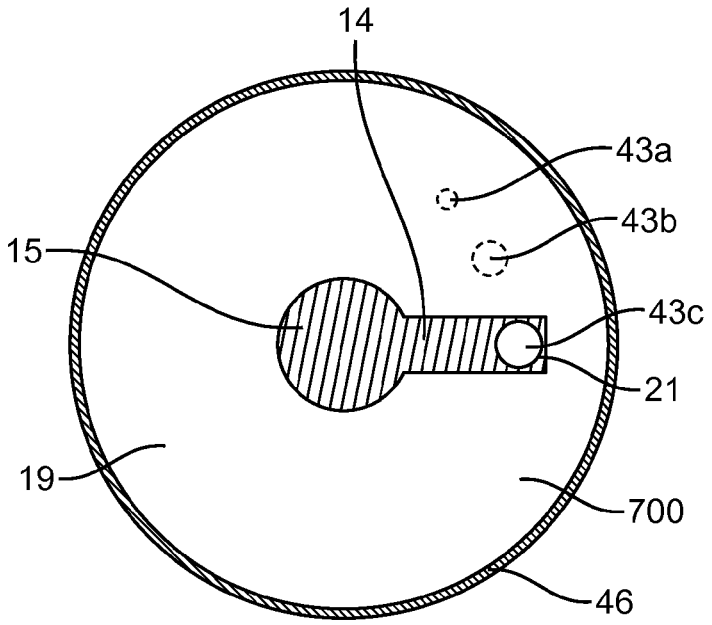
FIG. 12C is a diagram illustrating an overhead view of a portion of a bend angle sensing assembly according to the present disclosure at a third angle c.

FIGS. 12A-12D depict a transverse cross sectional view of a portion of the bend angle sensing assembly shown in FIG. 11. Fluid flow inlets 143*a*, 143*b*, and 143*c* are located within flow diverter 14, and are selectively placeable in fluid communication with exit port 21 of the fluid flow source 19 depending on the angle of the adjustable bent angle the adjustable bent housing 11. FIG. 12A corresponds to FIG. 11A where the flow diverter 14 is at a first angle a, relating to a first angle of the adjustable bent housing 11. At first angle a, such that fluid flow inlet 143*a* becomes engaged with the exit port 21 of the fluid flow source 19 and fluid flows through diversion flow channel 142*a*. Likewise, FIG. 12B corresponds to FIG. 11B where the flow diverter 14 is at a second angle b (greater than angle a), such that fluid flow inlet 143*b* becomes engaged with the exit port 21 of the fluid flow source 19 and fluid flows through diversion flow channel 142*b*. Finally, FIG. 12C corresponds to FIG. 11C where the flow diverter 14 is at a third angle (greater than both angle a and b), such that fluid flow inlet 143*c* becomes engaged with the exit port 21 of the fluid flow source 19 and fluid flows through diversion flow channel 142*c*.

Figure 12D:
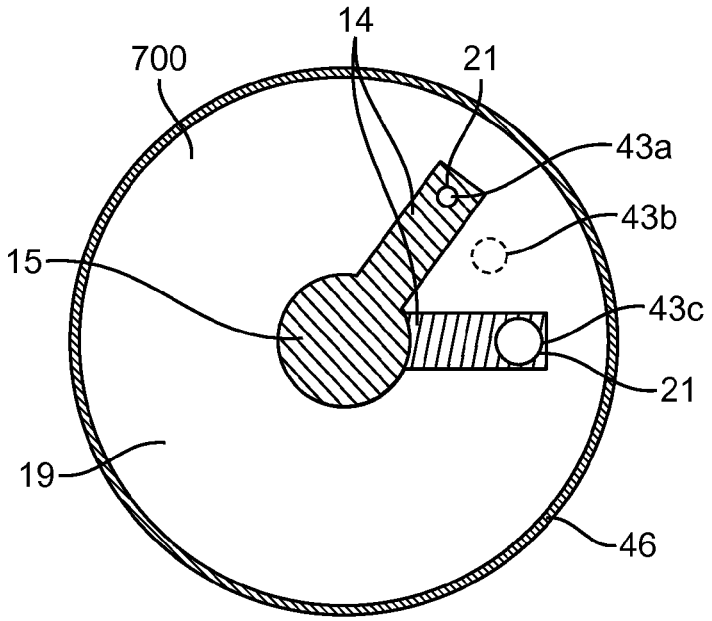
FIG. 12D is a diagram illustrating an overhead view of a portion of a bend angle sensing assembly according to the present disclosure.

In some examples, only one (or none) of fluid flow inlets 143*a*, 143*b*, and 143*c* can be in fluid communication with the exit port 21 of the fluid flow source 19 at any given time, and each of fluid flow inlets 143*a*, 143*b*, and 143*c* correspond to a different, predetermined bend angle. In other examples, multiple flow inlets can be in fluid communication with the exit port 21 of the fluid flow source 19 at any given time. This is represented in FIG. 12D, which shows both fluid flow inlets 143*a* and 143*c* in fluid communication with exit port 21 of the fluid flow source 19. This allows fluid flow through both diversion flow channels 142*a* and 142*c*. In this particular embodiment, fluid flow through both diversion flow channels 142*a* and 142*c* indicates that the adjustable bent housing is at an angle between angle a and angle c, which maybe a predetermined, discrete angle, or may merely indicate that the adjustable bent housing is at an angle somewhere between two discrete angles a and c.

The examples discussed in detail above refer to only three fluid flow channels (142*a*, 142*b*, and 142*c*), but the present disclosure is not limited to three fluid flow channels. It may include many fluid flow channels, for example, 4, 5, 6, 7, 8, 9, 10, 11, 12, 13, 14, or more flow channels.

As described above, the bent angle sensing assembly 11 according to the instant disclosure includes a flow diverter 14 having a plurality of differently configured diversion flow channels (e.g., 142*a*, 142*b*, and 142*c*) each having a selectable fluid flow inlet (e.g., 143*a*, 143*b*, and 143*c*) placeable in fluid communication with a diverted fluid flow source 19 in dependence upon the particular bend angle of the associated downhole adjustable bent housing (e.g., angles a, b, and c); and sensors (50, 52, or 53) communicatively coupled to the fluid source 19 and/or plurality of differently configured flow diversion channels (e.g., 142*a*, 142*b*, and 142*c*) for determining which of the plurality of differently configured flow diversion channels is experiencing fluid flow therethrough. The diverted fluid flow source 19 may have an exit port 21 selectively placeable in individual registration with each of the selectable fluid flow inlets (e.g., 143*a*, 143*b*, and 143*c*).

In some examples, multiple fluid flow inlets are allowed to be in registration with a fluid flow exit port 21 at any given time, depending on the downhole bend angle of the downhole adjustable bent housing, thereby bringing the flow channels associated with the fluid flow port(s) in fluid communication with the diverted fluid flow source 19 and allowing fluid flow therethrough. In other examples, each fluid flow inlet is allowed to be in registration with the fluid flow exit port at a different predetermined downhole bend angle of the downhole adjustable bent housing, such that the greater the bend, the more fluid flow inlets are in registration with the exit port.

In some examples, the bend angle sensing assembly is configured so that each fluid flow inlet is allowed to be in registration with the fluid flow exit port 21 at a different predetermined downhole bend angle, such that the lesser the bend, the more fluid flow inlets are in registration with the exit port. In other embodiments, only one fluid flow inlet is allowed to be in registration with the fluid flow exit port 21 at any given time.

The bend angle sensing assembly 11 described herein is useful in methods for determining the bend angle of a downhole adjustable bent housing 12. Such methods typically entail, for example, coupling the bend angle sensing assembly 11 to a downhole adjustable bent housing 12, determining which diversion channel(s) (e.g., 142*a*, 142*b*, 142*c*) is experiencing fluid flow therethrough, and calculating the bend angle of the downhole adjustable bent housing based on which diversion channel(s) (e,g., 142*a*, 142*b*, 142*c*) is experiencing fluid flow therethrough.

The controller disclosed herein can be communicatively coupled by wire or wirelessly with pressure or flow detectors herein. A controller can be provided in the bend sensing assembly 11 and/or anywhere along a drill string and/or at the service. The controller can provide any processing of the sensed pressure and flow rates to determine or output a bend angle orientation. The controller can include a processor optionally coupled directly or indirectly to memory elements through a system bus, as well as software or other program code for executing and carrying out processes described herein. In some implementations, the technology is implemented with software, which includes but is not limited to firmware, resident software, microcode, a Field Programmable Gate Array (FPGA) or Application-Specific Integrated Circuit (ASIC), etc.

Memory elements can include any computer usable or computer readable medium including any apparatus that can contain, store, communicate, propagate, or transport the software or other program code for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. A processor can include a microprocessor, a microcontroller, and/or a central processing unit, among others. While a single processor can be used, the present disclosure can be implemented over a plurality of processors as well. Both processors and program code for implementing each aspect of the technology can be centralized or distributed (or a combination thereof) as known to those skilled in the art.

Numerous examples are provided herein to enhance understanding of the present disclosure. A specific set of examples are provided as follows.

In a first example, a bend angle sensing assembly for determining a downhole bend angle of a downhole adjustable bent housing is disclosed, the, the bend angle assembly including a flow diverter having a plurality of diverter apertures for receiving drilling fluid, the flow diverter orientable to a plurality of configurations in dependence on the bend angle of the associated downhole adjustable bent housing, each of the plurality of configurations having one or more of the plurality of diverter apertures opening or closing to form a corresponding flow path configuration, each flow path configuration having a different flow area whereby the pressure of the drilling fluid changes for each flow path configuration; and a pressure sensor communicatively coupled to the drilling fluid.

In a second example, there is disclosed a bend angle sensing assembly according to the first example, wherein the flow diverter is fixedly coupled to an adjustment ring.

In a third example, there is disclosed a bend angle sensing assembly according to the second example, wherein the bend angle corresponds to an orientation of the adjustment ring for a plurality of bend angles.

In a fourth example, there is disclosed a bend angle sensing assembly according to any of the preceding examples second to the third, wherein the diverter is fixedly coupled to the adjustment ring via a shaft.

In a fifth example, there is disclosed a bend angle sensing assembly according to the fourth example, wherein the shaft comprises a bore for passage of drilling fluid.

In a sixth example, there is disclosed a bend angle sensing assembly according to any of the preceding examples first to the fifth, wherein the bend angle sensing assembly comprises a housing and an annulus between the housing and diverter.

In a seventh example, there is disclosed a bend angle sensing assembly according to the sixth example, wherein the flow diverter is rotatable within the housing.

In an eighth example, there is disclosed a bend angle sensing assembly according to any of the preceding examples first to the seventh, wherein the flow diverter comprises a non-rotating receiver having a plurality of receiver apertures.

In a ninth example, there is disclosed a bend angle sensing assembly according to the eighth example, wherein one or more of the plurality of receiver apertures align with one or more of the plurality of diverter apertures to open the diverter apertures.

In a tenth example, there is disclosed a bend angle sensing assembly according to any of the preceding examples eighth to the ninth, wherein the plurality of receiver apertures include at least two different sized receiver apertures.

In a eleventh example, there is disclosed a bend angle sensing assembly according to any of the preceding examples eighth to the tenth, wherein the plurality of receiver apertures comprise a first narrow set of receiver apertures and a second set of broad receiver apertures.

In a twelfth example, there is disclosed a bend angle sensing assembly according to any of the preceding examples eighth to the eleventh, wherein the diverter is rotatable to from a first diverter configuration to a second diverter configuration, wherein in the first configuration, the flow path configuration consists only of the annulus, and in the second configuration, the flow path configuration comprises the annulus and one of the narrow or broad receiver apertures.

In a thirteenth example, there is disclosed a bend angle sensing assembly according to any of the preceding examples first to the twelfth, wherein the bend angle sensing assembly is incorporated into a drill string having a mud motor.

In a fourteenth example, there is disclosed a bend angle sensing assembly according to the thirteenth example, wherein the mud motor includes a stator and rotor.

In a fifteenth example, a method is disclosed for determining the bend angle of a downhole adjustable bent housing including coupling a bend angle sensing assembly according to the first example to a downhole adjustable bent housing, detecting a detected pressure of a drilling fluid from the pressure sensor, and determining the bend angle of the downhole adjustable bent housing based on the detected pressure of the drilling fluid.

In a sixteenth example, a bend angle sensing system is disclosed including, a flow diverter having a plurality of diverter apertures for receiving drilling fluid, the flow diverter orientable to a plurality of diverter configurations in dependence on the bend angle of the associated downhole adjustable bent housing, each of the plurality of diverter configurations having one or more of the plurality of diverter apertures opening or closing to form a corresponding flow path configuration, each flow path configuration having a different flow area whereby the pressure of the drilling fluid changes for each flow path configuration; a pressure sensor communicatively coupled to the drilling fluid.

In a seventeenth example, a system is disclosed according to the sixteenth example further including a controller communicatively coupled to the pressure sensor, and having a processor configured for determining a bend angle in dependence on a sensed pressure.

In an eighteenth example, a system is disclosed according to examples sixteenth or seventeenth example, wherein the flow diverter is fixedly coupled to an adjustment ring.

In a nineteenth example, a system is disclosed according to any of the preceding examples sixteenth to the eighteenth, wherein the bend angle corresponds to an orientation of the adjustment ring for a plurality of bend angles.

In a twentieth example, a system is disclosed according to any of the preceding examples sixteenth to the nineteenth, wherein the bend angle sensing assembly includes a housing and an annulus between the housing and diverter.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A bend angle sensing assembly for determining a downhole bend angle of a downhole adjustable bent housing, the bend angle assembly comprising:

a flow diverter having a plurality of diverter apertures for receiving drilling fluid, the flow diverter orientable to a plurality of configurations in dependence on the bend angle of the associated downhole adjustable bent housing, each of the plurality of configurations having one or more of the plurality of diverter apertures opening or closing to form a corresponding flow path configuration, each flow path configuration having a different flow area whereby the pressure of the drilling fluid changes for each flow path configuration; and a pressure sensor communicatively coupled to the drilling fluid.

2. The bend angle sensing assembly of claim 1, wherein the flow diverter is fixedly coupled to an adjustment ring.

3. The bend angle sensing assembly of claim 2, wherein the bend angle corresponds to an orientation of the adjustment ring for a plurality of bend angles.

4. The bend angle sensing assembly of claim 2, wherein the diverter is fixedly coupled to the adjustment ring via a shaft.

5. The bend angle sensing assembly of claim 4, wherein the shaft comprises a bore for passage of drilling fluid.

6. The bend angle sensing assembly of claim 1, wherein the bend angle sensing assembly comprises a housing and an annulus between the housing and diverter.

7. The bend angle sensing assembly of claim 6, wherein the flow diverter is rotatable within the housing.

8. The bend angle sensing assembly of claim 7, wherein the flow diverter comprises a non-rotating receiver having a plurality of receiver apertures.

9. The bend angle sensing assembly of claim 8, wherein one or more of the plurality of receiver apertures align with one or more of the plurality of diverter apertures to open the diverter apertures.

10. The bend angle sensing assembly of claim 9, wherein the plurality of receiver apertures comprise at least two different sized receiver apertures.

11. The bend angle sensing assembly of claim 10, wherein the plurality of receiver apertures comprise a first set of receiver apertures having a first fluid flow path size and a second set of receiver apertures having a second fluid flow path size, wherein the second fluid flow path size is larger than the first fluid flow path size.

12. The bend angle sensing assembly of claim 11, wherein the diverter is rotatable to from a first diverter configuration to a second diverter configuration, wherein in the first configuration, the flow path configuration consists only of the annulus, and in the second configuration, the flow path configuration comprises the annulus and one of the first set of receiver apertures or the second set of receiver apertures.

13. The bend angle sensing assembly of claim 1, wherein the bend angle sensing assembly is incorporated into a drill string having a mud motor.

14. The bend angle sensing assembly of claim 13, wherein the mud motor comprises a stator and rotor.

15. A method for determining the bend angle of a downhole adjustable bent housing comprising:

coupling a bend angle sensing assembly according to claim 1 to a downhole adjustable bent housing, detecting a pressure of a drilling fluid from the pressure sensor, and determining the bend angle of the downhole adjustable bent housing based on the pressure of the drilling fluid.

16. A bend angle sensing system comprising, a flow diverter having a plurality of diverter apertures for receiving drilling fluid, the flow diverter orientable to a plurality of diverter configurations in dependence on the bend angle of the associated downhole adjustable bent housing, each of the plurality of diverter configurations having one or more of the plurality of diverter apertures opening or closing to form a corresponding flow path configuration, each flow path configuration having a different flow area whereby the pressure of the drilling fluid changes for each flow path configuration;

a pressure sensor communicatively coupled to the drilling fluid.

17. The bend angle sensing system of claim 16 further comprising a controller communicatively coupled to the pressure sensor, and having a processor configured for determining a bend angle in dependence on a sensed pressure.

18. The bend angle sensing system of claim 16, wherein the flow diverter is fixedly coupled to an adjustment ring.

19. The bend angle sensing system of claim 18, wherein the bend angle corresponds to an orientation of the adjustment ring for a plurality of bend angles.

20. The bend angle sensing system of claim 16, wherein the bend angle sensing assembly comprises a housing and an annulus between the housing and diverter.

* * * * *